United States Patent [19]

Bachem et al.

[11] Patent Number: 4,775,384

[45] Date of Patent: Oct. 4, 1988

[54] PROCESS FOR TREATING FIBRE MATERIALS

[75] Inventors: Henning Bachem, Cologne; Wolf-Dieter Schröer; Ergun Tamer, both of Leverkusen; Heinz-Dieter Feuser, Cologne, all of Fed. Rep. of Germany

[73] Assignee: Bayer Aktiengesellschaft, Leverkusen, Fed. Rep. of Germany

[21] Appl. No.: 24,637

[22] Filed: Mar. 11, 1987

[30] Foreign Application Priority Data

Mar. 25, 1986 [DE] Fed. Rep. of Germany ..... 3609984

[51] Int. Cl.[4] ..... D06M 15/00

[52] U.S. Cl. ..... 8/115.56; 528/405; 528/422

[58] Field of Search ..... 528/405, 422; 8/115.56

[56] References Cited

U.S. PATENT DOCUMENTS 3,803,237 4/1974 Lednicer et al. ..... 528/409

FOREIGN PATENT DOCUMENTS 1543136 9/1968 France .

*Primary Examiner*—Paul Lieberman
*Assistant Examiner*—John F. McNally
*Attorney, Agent, or Firm*—Sprung Horn Kramer & Woods

[57] ABSTRACT

A polymeric compound obtainable by reacting

A. a reaction product
   1. of a dihalogenohydrocarbon and/or dihalogenoalkyl ether and
   2. of a polyamine which contains primary and/or secondary amino groups and optionally tertiary amino groups, amide groups, urethane and/or urea groups and also ether groups in a molar ratio of 0.1 to 1.8:1 with B. an epihalogenohydrin or a 1,3-dihalogeno-2-hydroxypropane in a molar ratio of 0.2 mole to 5.0 moles of epihalogenohydrin per mole of base nitrogen or component A is used for treating fibre materials which contain hydroxyl or amide groups before or after dyeing or printing.

11 Claims, No Drawings

PROCESS FOR TREATING FIBRE MATERIALS

The present invention relates to a process for treating fibre materials which contain hydroxyl or amide groups with a polymeric compound which is obtainable by reacting A. a reaction product
   1. of a dihalogenohydrocarbon and/or dihalogenoalkyl ether and
   2. of a polyamine which contains primary and/or secondary amino groups and optionally tertiary amino groups, amide groups, urethane and/or urea groups and also ether groups in a molar ratio of 0.1 to 1.8:1 with B. an epihalogenohydrin or a 1,3-dihalogeno-2-hydroxypropane in a molar ratio of 0.2 mole to 5.0 moles of epihalogenohydrin per mole of base nitrogen of component A before or after dyeing or printing, and to agents which contain such a polymeric compound.

Suitable dyestuffs are the dyestuffs known for the fibre materials mentioned, such as reactive or direct dyestuffs, di- or triphenylmethane dyestuffs, phthalocyanine, acid, formazan, indigo or 1:1 or 1:2 metal complex dyestuffs.

The textile fibre used is preferably cotton or regenerated cellulose, natural or synthetic polyamides, optionally in mixture with other textile materials, such as polyester or polyacrylonitrile.

The dyed or printed fibres mentioned frequently have an inadequate wash fastness, in particular at elevated temperature, since the bonded dyestuff partly dissolves on washing.

The preferred way of overcoming these disadvantages in the field is the use of cationic aftertreatment agents.

For instance, British Patent Specification No. 865,727 discloses preparing finishing agents for cellulose-containing products by reacting polyamides with epihalogenohydrin and optionally quaternizing the resulting product.

German Offenlegungsschriften Nos. 3,446,282 and 2,747,358 disclose preparing cationic aftertreatment agents for textile fibres by reacting polyalkylenepolyamines with epichlorohydrin.

German Patent Specifications Nos. 836,644 and 855,001, French Patent Specification No. 1,149,191, Swiss Patent Specifications Nos. 253,709 and 261,049, British Patent Specification No. 2,099,007 and German Offenlegungsschrift No. 3,422,822 describe reaction products of polyalkylenepolyamines with cyanamide, dicyanodiamide, guanidine or biguanidine and optionally subsequent further reaction with epihalogenohydrin and their use as textile auxiliaries.

German Offenlegungsschrift No. 2,400,052 discloses the reaction of cyanamide, dicyanodiamide or guanidine resins, cationic amines having a primary and a quarternary amino group and s-triazines, such as cyanuric chloride, for preparing a reactive aftertreatment agent.

German Offenlegungsschrift No. 2,364,444 and U.S. Pat. No. 4,129,528 describe cationic resin formulations for increasing the wet strength of cellulose substrates, which are prepared by reacting polyalkylenepolyamines with dihalogenoalkanes and subsequent further reaction with epichlorohydrin.

French Patent Specification No. 1,543,136 describes the reaction of polyamideamines with dihalogenoalkanes and further condensation with epichlorohydrin and the use of the products as dry and wet strength agents for paper.

German Pat. No. 727,917 describes the quaternization of polyalkyleneimines to cationic polycondensates and their use as textile auxiliaries.

The polymers to be used according to the invention are preferably prepared by reacting (A) a reaction product of 1. (a) a dihalogenohydrocarbon of the formula

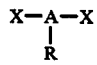

(I)

wherein

X denotes a halogen atom,

R denotes hydrogen or an optionally hydroxyl-substituted $C_1$–$C_4$-alkyl radical and A denotes a $C_2$- to $C_6$-alkylene, cyclohexylene or a xylylene group, and/or (b) a dihalogenoether of the formula

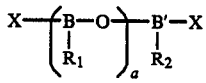

(II)

wherein

X denotes a halogen atom, $R_1$ and $R_2$, independently of each other, denote hydrogen, a hydroxyl group, an optionally hydroxyl-substituted $C_1$–$C_4$-alkyl radical, B and B', independently of each other, denote a $C_2$- to $C_6$-alkylene radical and a denotes 1 or 2, and 2. (a) a polyamine which contains a primary and/or secondary and optionally tertiary amino group and has the formulae (III–V)

(α)

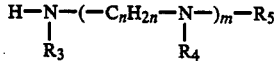

(III)

in which $R_3$, $R_4$ and $R_5$, independently of one another, denote hydrogen or a $C_1$–$C_4$-alkyl radical which can be substituted by a hydroxyl, cyano or carboxamide group, m denotes a whole number from 1 to 5 and n denotes a whole number of at least 2, preferably 2 to 6,

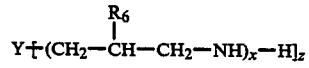

(IV)

in which

Y stands for oxygen, sulphur, $—CH_2—CH_2—$ or $—S—CH_2—CH_2—S—$, $R_6$ stands for a hydrogen atom or methyl-, x stands for a whole number from 1 to 5 and z stands for a whole number from 2 to 5, and (γ)

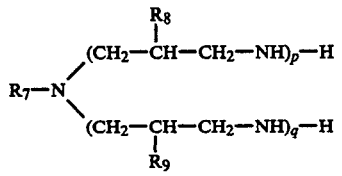

(V)

in which $R_7$ stands for a $C_1$- to $C_{18}$-alkyl radical which can be substituted by an amino or hydroxyl group, $R_8$ and $R_9$, independently of each other, stand for hydrogen or methyl and p and q stand for a whole number from 1 to 5, (δ)1,4-diaminocyclohexane, aminoethylpiperazine, 4,4'-diaminodicyclohexylmethane, 4,4'-diaminodiphenylmethane and/or (ε) a polyimine obtainable by polymerization of 1,2-alkyleneimines, and/or (b) a polyamideamine having a molecular weight of at least 1,000, prepared from:

(α) aliphatic polyamines which contain at least two amino groups capable of amide formation and at least one further secondary or tertiary amino group, (β) aliphatic or aromatic dicarboxylic acids having 2 to 12 C atoms or their functional derivatives, such as anhydrides, esters, semi-esters or amides, and/or (γ) aminocarboxylic acids which contain 3–6 C atoms, or the lactams thereof, and/or (c) a polyetheramine, and/or (d) a polyurethane having secondary amino groups and/or (e) a polyurea having secondary amino groups where 1. and 2. are reacted in a molar ratio of 0.1 to 1.8:1, preferably 0.9 to 1.5:1 (for 2a) or 0.1 to 0.7:1 (for 2b to 2e), with (B) an epihalogenohydrin or 1,3-dihalogeno-2-hydroxypropane, in a molar ratio of 0.2 to 5.0 moles, preferably 1.0 to 3.0 moles, of component B per mole of base nitrogen of component A.

Of these polymeric compounds, a particular mention should be given to those which are obtainable by reacting A. a reaction product of a dihalogenohydrocarbon (1.) and a polyamine 2.a), (γ), (δ) and/or (ε) and/or a polyamideamine 2.(b) in a molar ratio of 0.1 to 1.8:1, preferably 0.9 to 1.5:1 (for 2a) or 0.1 to 0.5:1 (for 2b), and B. epichlorohydrin or 1,3-dichloro-2-hydroxypropane.

The products thus formed are water-soluble, cationic polycondensates which, at 25° C. and a solids content of 5 to 40% by weight, preferably 10 to 30% by weight, have a viscosity of 30 to 500 mPas, preferably 40 to 200 mPas.

Precursors A are prepared by known processes, in which mixtures of (1) and (2) are reacted in an aqueous medium at pH values above 6 and temperatures between 20° and 150° C., optionally under pressure, until a sample of the mixture has at 25° C., in the form of a 10% strength, aqueous solution, a viscosity of at least 20 mPas.

In this connection, it is frequently of advantage to add the dihalogenohydrocarbon or the dihalogenoether gradually a little at a time until the desired viscosity is obtained. The solids content is preferably 10 to 60% by weight and can be adjusted to the desired final value by diluting with water.

The condensation reaction can be carried out for example at pressures between 0.5 and 50 bar, preferably 1 to 8 bar, above the boiling point of the compound which is polyfunctional with respect to amino groups.

The polycondensates are characterized by a minimum molecular weight of 2,000, the upper limit being defined by the condition of water solubility, i.e. the number of water-solubilizing groups and the parent polyamine.

The further reaction of products A with B is likewise effected by methods known per se. Thus, for example, a compound B can be made to react with a precursor A by stirring aqueous, approximately 20 to 50% strength solutions of the two components at a temperature between 25° and 95° C., preferably between 40° and 75° C., until a sample of the reaction mixture in the form of a 10% strength, aqueous solution at 25° C. has a viscosity of at least 20, preferably 40 to 100, mPas.

The reaction mixture then expediently has added to it, to end the reaction and to stabilize the self-crosslinking reaction products, sufficient acid, for example hydrochloric acid, sulphuric acid or formic acid, that the pH value is between 2 and 6, preferably between 2 and 4, and the solids content is diluted with water to 10 to 30% by weight.

In this way, clear, aqueous solutions which still contain reactive groups and have a long shelf life are obtained.

Dihalogen compounds (I) which may be named are: 1,2-dichloroethane, 1,2-dibromoethane, 1-chloro-2-bromoethane, 1,2-dichloropropane, 1,2-dichlorobutane, 1,3-dichloropropane, 1-chloro-3-bromopropane, 1,3-dichlorobutane, 1,4-dichlorobutane, 1,5-dichloropentane, 1,6-dichlorohexane, 1,4-cyclohexylene dichloride and p-xylylene dichloride.

Preferred dihalogenoethers (II) are: bis-(-β-chloroethyl) ether, bis-(-β-chloroisobutyl) ether, bis-(4-chlorobutyl) ether, bis-(3-chloro-2-hydroxypropyl) ether, bis-(γ-chloropropyl) ether and ethylene glycol bis-(β-chloroethyl) ether.

Examples of representatives of amines (III) are: ethylenediamine, 1,2-diaminopropane, 1,3-diaminopropane, 1,6-diaminohexane, N-(2-hydroxyethyl)-ethylenediamine, 1,4-diaminobutane, diethylenetriamine, triethylenetetramine, tetraethylenepentamine, pentaethylenehexamine, N-(3-aminopropyl)-tetramethylenediamine, N,N'-bis-(3-aminopropyl)-ethylenediamine, dipropylenetriamine, N,N'-dimethylethylenediamine, N-(β-hydroxyethyl)-ethylenediamine, 1-amino-3-methylaminopropane, N,N'-bis-(3-aminopropyl)tetramethylenediamine, di-(hexamethylene)-triamine and 1-amino-3-dimethylaminopropane.

Examples of representatives of amine (IV) are: bis-(3-aminopropyl) ether, bis-(3-aminopropyl) sulphide, ethylene glycol bis-(3-aminopropyl) ether and dithioethylene glycol bis-(3-aminopropyl) ether.

Preferred amines of the formula (V) are: methylbis-(3-aminopropyl)-amine, ethylbis-(3-aminopropyl)-amine, 2-hydroxyethyl-bis-(3-aminopropyl)-amine, n-butyl-bis-(3-aminopropyl)-amine and tris-(3-aminopropyl)-amine.

Preferred polyimines (2 a ε) are prepared by polymerizing ethyleneimine.

Examples of polyamines (2 b α) have been mentioned in connection with amines (III):

Preference is given to diethylenetriamine, triethylenetetramine, tetraethylenepentamine, pentaethylenehexamine, dipropylenetriamine, N-(3-aminopropyl)-tetramethylenediamine, N,N'-bis-(3-aminopropyl)-tetramethylenediamine and N,N'-bis-(3-aminopropyl)-ethylenediamine.

Preferred dicarboxylic acids (2 b β) are $C_1$–$C_{12}$-alkylenedicarboxylic acids such as malonic acid, glutaric acid, adipic acid, sebacic acid, 1,12-dodecanedioic acid or terephthalic acid or isophthalic acid.

Preferred compound (2 b γ) is ε-caprolactam.

Polyetheramines (2 c) which may be named are:

compounds prepared from aliphatic polyamines (cf. German Offenlegungsschrift 1,570,296) with polyepihalogenohydrins which contain 2 to 30 halogenomethyl radicals; by reaction of polyglycols containing 8 to 50 ethylene oxide units with epihalogenohydrin and the terminal OH functions to give α,ω-dichlorohydrin ethers and further reaction with polyamines, amines or ammonia; or by reacting polyglycdl ethers with polyacrylonitrile and subsequent hydrogenation.

Polyurethanes (2 d) which may be mentioned are:

the polyamines which contain urethane groups and are obtained from bisfunctional or more highly functional chloroformic acid esters and polyfunctional aliphatic amines as described in German Patent Specifications Nos. 851,550 and 1,301,118, and polyureas (2 e) which may be mentioned are:

reaction products of diisocyanates and aliphatic, polyfunctional amines, and reaction products of urea and polyfunctional amines, of the type described for example in German Offenlegungsschrift No. 2,925,567.

Preferred examples of dihalogen compounds (B) are epichlorohydrin, epibromohydrin and 1,3-dichloro-2-hydroxypropane.

Particularly preferred polymers to be used according to the invention are prepared from A. a reaction product of 1. 1,2-dichloroethane, 1,2-dichloropropane, 1-chloro-3-bromopropane, 1,6-dichlorohexane and/or p-xylylene dichloride and
2. a polyamideamine of diethylenetriamine and adipic acid having an average molecular weight of 3,000 to 10,000 in a molar ratio of 0.1 to 0.5:1 and/or hexamethylenediamine and/or aminoethylpiperazine and/or an amine $$H_2N-C_bH_{2b}-\overset{\overset{\displaystyle CH_3}{|}}{N}-C_bH_{2b}-NH_2$$

with b=2 or 3 in a molar ratio of 0.9 to 1.5:1, and/or a polyethyleneimine in a molar ratio of 0.1 to 0.6:1 and B. epichlorohydrin in a molar ratio of 1.3 to 3.0 moles of epichlorohydrin per mole of base nitrogen of component A.

The after treatment according to the invention of the dyed or printed textile material is carried out by methods of the pad-mangling process known per se, such as the thermofixing, pad-dry, pad-roll or pad-steam process with or without intermediate drying or even by the pad/cold-batch process.

Another preferred way of carrying out the aftertreatment is the exhaust method from a short or long liquor.

If the aftertreatment is carried out by the exhaust method using liquor ratios of 1:5 to 1:50. the application rate of the substances of the process according to the invention is between 0.1 and 4.0% (of 100% strength material), preferably 0.25 to 2.0% (of 100% strength material), relative to the dry weight of the textile material.

If the aftertreatment is carried out as a continuous process on a pad-mangle, 1.0 to 40 g (of 100% strength material), preferably 2.5 to 20 g (of 100% strength material) of polymeric product are used per liter of padding liquor for a wet pick-up of 100%.

The dyed or printed textile material is chiefly aftertreated at temperatures of 20° to 100° C., advantageously at 20° to 60° C., and a pH value of 5 o 11, preferably 6 to 8, for 5 to 60 minutes, the pH value being appropriately set by means of an aqueous alkali metal carbonate or ammonia solution. Optionally the dyeing is rinsed beforehand at 20° to 100° C. with water.

The pretreatment of the textile material with the polymeric product is likewise carried out by commonly known methods, such as the exhaust method or by pad-mangling, spraying or foam.

This pretreatment is carried out at a pH value of 6 to 11, preferably 6.5 to 9, and at temperatures of 20° to 100° C., advantageously of 30° to 60° C.

If the pretreatment is carried out by the exhaust method, 0.1 to 4.0% (of 100% strength material), preferably 0.25 to 2.0% (of 100% strength material) are used, relative to the dry weight of the textile material.

If the pretreatment is carried out on a pad-mangle, 1 to 40 g, preferably 2.5 to 20 g (of 100% strength material) are used per liter of padding liquor in the case of a wet pick-up of 100%. The dyeing or printing of the pretreated textile material can be carried out at pH values of 5 to 11, preferably 6 to 9.

The polymeric compounds are crosslinked on the fibre under restrictively weakly acid, neutral or slightly alkaline conditions, fixing being effected, with or without prior drying, at 70° to 180° C. in the course of 30 seconds to 10 minutes.

The aftertreatment process is the preferred process.

If the process is applied to cellulose, preferably reactive, direct, di- or triphenylmethane, phthalocyanine, formazan or indigo dyestuffs are used for dyeing or printing by the exhaust or continuous method.

Preference is given here to direct dyestuffs which contain metal complexes, in particular to copper complex dyestuffs, of the type described in the Colour Index, 3rd edition, volume 2 (1971) on pages 2005 to 2478.

The highly substantive dyes used therein advantageously contain at least two $SO_3H$ or OH groups or at least three $NH_2$ groups.

Particular preference is given to using the following dyestuffs:

CI Direct Red—79, 80, 89, 211, 212, 218
CI Direct Yellow—27, 50, 53, 106
CI Direct Green—26
CI Direct Violet—47, 48, 95
CI Direct Blue—71, 98, 218, 225, 229, 243, 244
CI Direct Brown—100
CI Direct Black—22, 112

Suitable reactive dyestuffs are dyestuffs of the type described for example in Venkataraman, The Chemistry of Synthetic Dyes, Volume VI, Reactive Dyes (Academic Press, New York, London 1972).

Preferably they contain 1 to 3 radicals of a 5-or 6-membered heterocyclic ring of aromatic character. The heterocyclic rings preferably have 2 or 3 N atoms and are substituted by 1 to 3 halogen atoms, in particular chlorine or fluorine. These dyestuffs have properties not only of a direct dyestuff but also of a reactive dyestuff. stuff.

For dyeing or printing natural or synthetic polyamides, use is made of acid dyestuffs, the so-called CI Acid Dyes, as described in the Colour Index, 3rd edition, volume 2 (1971) on pages 1001–1562, and preferably 1:1 or 1:2 metal complex dyestuffs.

Particular preference is given to using the following dyestuffs:

CI Acid Blue—49, 335
CI Acid Red—296, 414
CI Acid Green—50
CI Acid Brown—415
CI Acid Black—220

In the treatment of wool, it is possible to use unchlorinated wool, chlorinated wool or even wool which has been given an antifelting finish with a cationic auxiliary (synthetic resin).

In general, the use of cationic auxiliaries for improving the fastness properties of textile fibres is suitable, although, in particular at elevated wash temperature, such as, for example, 40° to 60° C., the improvement is very small. Reactive dyestuffs, as a consequence of their chemical bond with the fibre, still give the best fastness properties, although an unfixed dyestuff portion (hydrolysate) is removed from the fibre by costly washing.

The treatment agents to be used according to the invention have on account of their cationic character and high substantivity, a strong affinity for the fibres and hence good dyeing properties.

Moreover, the reactive products are capable of firmly attaching to the fibre by means of a chemical bond.

The process according to the invention gives particularly good results in the aftertreatment of dyed cellulose and wool.

For instance, the colour yields and the fastness properties of the dyes and prints described, in particular the wash fastness at 40° to 60° C. on cellulose or the IWS wash (TM 193) at 50° C. on wool, or even the light fastness and the alkaline perspiration fastness compared with other cationic auxiliaries without adversely affecting the required rub fastness.

EXAMPLE 1

160 g of 50% strength, aqueous solution of a polyamideamine (preparation as described in EP 0,002,474, Example A1) are diluted with 310 ml of water. 9.0 g of 1,2-dichloroethane are added at 90° C. Stirring is continued until a viscosity of 200 mPas is obtained, which is followed by cooling down and diluting with water.

Viscosity: 65 mPas (25° C.), solids content: 16.0% by weight

EXAMPLE 2

232 g of hexamethylenediamine, 72.5 g of methyl-bis-(3-aminopropyl)-amine, 64.5 g of aminoethylpiperazine and 92 ml of water are introduced first at 80° C. 267 g of 1,2-dichloroethane are added in the course of 45 minutes. This is followed by stirring at 90° C. for 7 hours, during which water is added a little at a time to give a 50% strength solution.

Viscosity: 73 mPas (25° C.).

EXAMPLE 3

A high-pressure reactor is charged with 725 g of methyl-bis-(3-aminopropyl)-amine and 1,490 ml of water, 500 g of 1,2-dichloroethane are then added at 120° C. in the course of 1 hour, and stirring is continued for 90 minutes. 2,150 ml of water are then added dropwise, which is followed by venting and degassing.

Viscosity: 85 mPas (25° C.)
Solids content: 25.0% by weight.

EXAMPLE 4

145.3 g of methyl-bis-(3-aminopropyl)-amine and 36.3 ml of water are introduced first at 80° C., and 89.1 g of 1,2-dichloroethane/11.3 g of 1,2-dichloropropane are added in the course of 1 hour. This is followed by stirring at 90° C. for 12 hours and the addition of water a little at a time to produce a 50% strength aqueous solution.

Viscosity: 634 mPas (25° C.).

EXAMPLE 5

145.3 g of methyl-bis-(3-aminopropyl)-amine and 63 ml of water are introduced first, and at 80° C. a mixture of 89.1 g of 1,2-dichloroethane and 17.5 g of p-xylylene dichloride is added in the course of 1 hour. This is followed by stirring at 90° C. for a further 6 hours and the addition of water a little at a time to produce a 25% strength aqueous solution.

Viscosity: 137 mPas (25° C.).

EXAMPLE 6

300 g of a polyetheramine (preparation as described in German Offenlegungsschrift No. 3,413,567, Example A8) and 200 ml of water are introduced first, and at 80° C. 35.0 g of 1,2-dichloroethane are added in the course of 1 hour. This is followed by stirring at 90° C. for 10 hours and diluting with water a little at a time.

Viscosity: 443 mPas (25° C.)
Solids content: 28.5% by weight

EXAMPLE 7

220 g of a polyurea (preparation as described in German Offenlegungsschrift No. 2,925,567, Example A1), 132 g of tetraethylenepentamine and 400 ml of water are introduced first. 140 g of 1,2-dichloroethane are added at 80° C. in the course of 2 hours. This is followed by 12 hours of stirring at 90° C. and dilution with water a little at a time.

Viscosity: 167 mPas (25° C.)
Solids content: 24.8% by weight

EXAMPLE 8

200 g of the precursor described in Example 1 (16% strength aqueous solution) are introduced first, and 150 ml of water are added, followed at 25° to 30° C. dropwise by 27.8 g (0.3 mol) of epichlorohydrin in the course of 45 minutes.

The reaction mixture is subsequently stirred at 30° C. for 1 hour and then heated to 70° C. After about 1 hour the viscous reaction mixture is diluted by adding 150 ml of water and is allowed to become viscous again, and the condensation is terminated by adding a hydrochloric acid solution (pH 3).

Viscosity: 63 mPas (25° C.)
Solids content: 10.9% by weight

EXAMPLE 9

178.2 g of the 50% strength aqueous solution of the precursor described in Example 2 are introduced first in a mixture with 436 ml of water, and 77.7 g (0.84 mol) of epichlorohydrin are added dropwise at 25° C. in the course of 45 minutes. The mixture is then stirred at 30° C. for 30 minutes, 8 g of methyl-bis-(3-aminopropyl)-amine are added, and the temperature is raised to 85° C. After 1 hour the reaction mixture is diluted by adding 336 ml of water, is allowed to become viscous again, and is then brought to pH 2 by adding a sulphuric acid solution.

Viscosity: 58 mPas (25° C.)
Solids content: 16.4% by weight.

EXAMPLE 10

270 g of the precursor described in Example 3 (25% strength solution in water) are introduced first and diluted with 375 ml of water, and 55.6 g (0.6 mol) of epichlorohydrin are added dropwise at 25° C. in the course of 45 minutes. The reaction mixture is subsequently stirred at 30° C. for 1 hour and heated to 70° C., the viscosity rising all the while. The reaction medium is brought to pH 3.5 before crosslinking by adding a formic acid solution and degassed.

Viscosity: 80 mPas (25° C.)
Solids content: 17.0% by weight

EXAMPLE 11

To an initial charge of 103.6 g of the precursor described in Example 4 and 355 ml of water are added dropwise, at 25° to 30° C., 55.5 g (0.6 mol) of epichlorohydrin in 45 minutes, and the mixture is subsequently stirred for 1 hour and then heated to 70°-80° C. After about 30 minutes a further 355 ml of water are added to the viscous solution, which is allowed to become viscous again (about 2 hours) and is then brought to pH 2.5 by adding a hydrochloric acid solution.

Viscosity: 47 mPas (25° C.)
Solids content: 11.8% by weight

EXAMPLE 12

166.8 g of the precursor described in Example 5 (25% strength, aqueous solution) and 200 ml of water are introduced first, and 46.3 g of epichlorohydrin are added dropwise at 25°-30° C. in the course of 45 minutes. The reaction solution is subsequently stirred for 1 hour and then heated to 70°-80° C. To the reaction solution, which is becoming more viscous, are added 60 ml of water, and the reaction solution is allowed to become viscous again and then brought to pH 3 by adding formic acid.

Viscosity: 91 mPas (25° C.)
Solids content: 17.5% by weight

EXAMPLE 13

An initial charge of 200 g of the precursor described in Example 6 and 200 ml of water are reacted with 18.5 g (0.2 mol) of epichlorohydrin as described in Example 8. During the condensation the reaction solution is diluted once more with 120 ml of water.

Viscosity: 108 mPas (25° C.)
Solids content: 12.5% by weight

EXAMPLE 14

An initial charge of 260 g of the precursor of Example 7 and 260 ml of water are reacted with 37.0 g (0.4 mol) of epichlorohydrin as in Example 8. During the condensation the reaction solution is diluted once more with 100 ml of water.

Viscosity: 78 mPas (25° C.)
Solids content: 15.1% by weight

EXAMPLE 15

A rinsed 4% strength cotton exhaust dyeing obtained with the dye of German Auslegeschrift No. 1,544,559, Example 1, is treated for 30 minutes at pH 7 at 30° C. in a liquid:substrate ratio of 20:1 with an aqueous solution which contains 1.5% (based on the dry weight of the substrate) of the polymeric compound (100% strength material) of Example 9.

This is followed by rinsing with cold water and fixing at 150° C. for 5 minutes.

This gives a dyeing of distinctly improved wash fastness in the 60° C. wash.

EXAMPLE 16

A rinsed 4% strength cotton exhaust dyeing obtained with the dye of German Auslegeschrift No. 1,061,460, Example 1, column 4, lines 64, 65, is aftertreated for 30 minutes at pH 7 and 60° C. in an aqueous liquor with the liquor ratio of 20:1 with 1% (relative to the dry weight of the substrate) of the polymeric compound (100% strength material) of Example 10. This is followed by rinsing with cold water and drying.

In this way a significant improvement in the wash fastness in the 60° C. wash is obtained.

EXAMPLE 17

A rinsed 4% strength cotton exhaust dye obtained with C.I. Direct Blue 98 (=NO. 23,155) is impregnated on a pad-mangle with a solution which contains 10 g/l of polymeric compound (100% strength material) of Example 11 at pH 7 at 20° C. and subsequently fixed at 150° C. in the course of 5 minutes.

The wash fastness of the cotton dyeing in the 40° wash is distinctly improved.

EXAMPLE 18

Wool yarns which have been finished with Hercosett S7 "Superwash" are treated at 25° C. for 15 minutes in a liquor ratio of 20:1 with a dyeing which contains per liter 1.2 g of the dyestuff of German Auslegeschrift No. 2,404,314, Example 54,
2.0 g of $Na_2SO_4$
1.4 g of $CH_3CHOOH$ (60% strength)
0.5 g of the levelling agent of the following formula

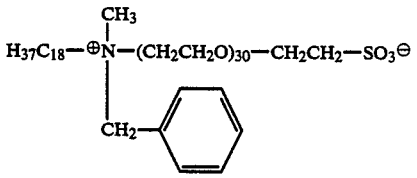

The dyebath is heated to the boil in the course of 60 minutes and is maintained at that temperature for 60 minutes. The yarns are subsequently rinsed and aftertreated at 50° C. for 30 minutes with a liquor which contains per liter 5.0 g of the reaction product of Example 9 and has been brought to pH 9.0-9.5 with sodium carbonate. This is followed by rinsing, acidifying with acetic acid and drying.

Fastness tests on this aftertreated dyeing show that the fastness level is significantly improved by the aftertreatment, so that the IWS specifications (IWS-TM 193, IWS-TM 174) are easily achieved; this is effected without adverse effect on the rub fastness.

We claim:

1. A process for dyeing or printing textile fiber materials which contain hydroxyl or amide groups comprising treating the textile fiber materials before or after the dyeing or printing with a polymeric compound which is produced by reacting A. a reaction product (1.) of a dihalogenohydrocarbon and/or dihalogenoalkyl ether and (2.) of a polyamine which contains primary amino groups, secondary amino groups, tertiary amino groups, amide groups, urethane, and/or urea groups, ether groups or mixtures thereof said (1.) and (2.) being present in a molar ratio of 0.1 to 1.8:1 with B. an epihalogenohydrin or a 1,3-dihalogeno-2-hydroxy -propane in a molar ratio of 0.2 mole to 5.0 moles of epihalogenohydrin per mole of base nitrogen of component A.

2. A process according to claim 1, wherein the polymeric compound is produced by reacting 1. (a) a dihalogenohydrocarbon of the formula

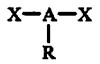

wherein

X denotes a halogen atom,

R denotes hydrogen or an unsubstituted or hydroxyl-substituted $C_1$–$C_4$-alkyl radical and A denotes a $C_2$- to $C_6$-alkylene, cyclohexylene or a xylylene group, and/or (b) a dihalogenoether of the formula

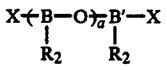

wherein

X denotes a halogen atom, $R_1$ and $R_2$, independently of each other, denote hydrogen, a hydroxyl group, an unsubstituted or hydroxyl-substituted $C_1$–$C_4$-alkyl radical, B and B', independently of each other, denote a $C_2$- to $C_6$-alkylene radical and a denotes 1 or 2, and 2. (a) a polyamine which contains a primary and/or secondary and optially tertiary amino group and has the formula α-γ

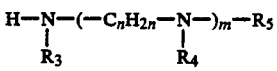

in which $R_3$, $R_4$ and $R_5$, independently of one another, denote hydrogen or a $C_1$–$C_4$-alkyl radical which is unsubstituted or substituted by a hydroxyl, cyano or carboxamide group, m denotes a whole number from 1 to 5 and n denotes a whole number of at least 2, (β)

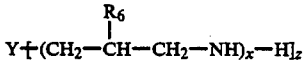

in which

Y stands for oxygen, sulphur, —O—$CH_2$—$CH_2$—O or —S—$CH_2$—$CH_2$—S—, $R_6$ stands for a hydrogen atom or methyl-, x stands for a whole number from 1 to 5 and z stands for a whole number from 2 to 5, and (γ)

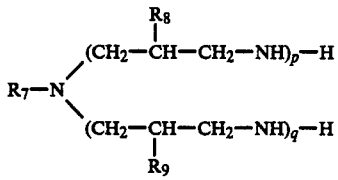

in which $R_7$ stands for a $C_1$- to $C_{18}$-alkyl radical which is unsubstituted or substituted by an amino or hydroxyl group, $R_8$ and $R_9$, independently of each other, stand for hydrogen or methyl and p and q stand for a whole number from 1 to 5, (δ) 1,4=diaminocyclohexane, aminoethylpiperazine, 4,4'-diaminodicyclohexylmethane, 4,4'-diaminodiphenylmethane and/or (ε) a polyaminie obtanable by polymerization of 1,2-alkyleneimines, and/or (b) a polyamideamine having a molecular weight of at least 1,000, prepared from:

(α) aliphatic polyamines which contain at least two amino groups capable of amide formation and at least one further secondary or tertiary amino group, (β) aliphatic or aromatic dicarboxylic acids having 2 to 12 C atoms or their functional derivatives, and/or (γ) aminocarboxylic acids which contain 3–6 C atoms, or the lactams thereof, and/or (c) a polyetheramine, and/or (d) a polyurethane having secondary amino groups and/or (e) a polyrea having secondary amino group, where 1. and 2a. are reacted in a molar ratio of 0.7 to 1.8:1, and/or 0.1 to 0.7:1 for 2b–2e, with (B) an epihalogenohydrin or 1,3-diahalogeno-2-hydroxypropane, in a molar ratio of 0.2 to 5.0 moles, of component B per mole of base nitrogen of component A.

3. A process according to claim 2, wherein the polymeric compound is produced by reacting A. a reaction product of a dihalogenohydrocarbon 1.(a) and a polyamine 2.(a)(α),(γ),(δ) and/or (ε) and/or a polyamideamine 2.(b) and B. epichlorohydirn or 1,3-dichloro-2-hydroxypropane.

4. A process according to claim 2, wherein the polymeric compound is produced by reacting A. a reaction product of 1. 1,2-dichloroethane, 1,2-dichloropropane, 1-chloro-3-bromopropane, 1,6-dichlorohexane and/or p-xylylene dichloride and 2. a polyamideamine of diethylenetriamine and adipic acid having an average molecular wight of from 3,000–10,000 in a molar ratio of 0.1 to 0.5:1 and/or hexamethylenediamine and/or aminoethylpiperazine and/or an amine $$H_2N-C_bH_{2b}-\overset{\overset{\displaystyle CH_3}{|}}{N}H-C_b-H_{2b}-NH_2$$

with b=2 or 3 and/or a polyethyleneimine in a molar ratio of 0.1 to 0.6:1 and

B. epichlorohydrin in a molar ratio of 1.3 to 3.0 moles of epichlorohydrin per mole of base nitrogen of component A.

5. A process according to claim 1, wherein the treatment is effected by an exhaust or continuous method.

6. A process according to claim 1, wherein the treatment is carried out after dyeing or printing.

7. A process according to claim 1, wherein the fiber material is selected from the group consisting of cellulose and wool.

8. A process according to claim 2, wherein n is 2 to 6.

9. A process according to claim 2, wherein the functional derivatives of aliphatic or aromatic dicarboxylic acids are selected from the group consisting of anhydrides, esters, semi-esters and amides.

10. A process according to claim 2, wherein 1. and 2a. are reacted in a molar ratio of 0.9 to 1.5:1.

11. A process according to claim 2, wherein the molar ratio of B per mole of base nitrogen of A is 1.0 to 3.0 moles.

* * * * *

UNITED STATES PATENT AND TRADEMARK OFFICE

CERTIFICATE OF CORRECTION

PATENT NO. : 4,775,384

DATED : Oct. 4, 1988

INVENTOR(S) : Bachem et al.

It is certified that error appears in the above-identified patent and that said Letters Patent is hereby corrected as shown below:

| | |
|---|---|
| Title Page, under "ABSTRACT", line 13 | Delete "or" and substitute --of-- |
| Col. 2, line 57 | Insert --(B)-- before formula |
| Col. 2, line 63 | Delete "$-CH_2-CH_2-$" and substitute --$O-CH_2-CH_2-O$-- |
| Col. 5, line 23 | Correct spelling of --polyglycol-- |
| Col. 7, line 5 | Delete "stuff." in second instance |
| Col. 11, line 58 | Insert --(a)-- before the formula |
| Col. 12, line 34 | Delete "polyaminie obtanable" and substitute --polyimine obtainable-- |

Signed and Sealed this

Eighth Day of August, 1989

*Attest:*

*Attesting Officer*

DONALD J. QUIGG

*Commissioner of Patents and Trademarks*